US005555565A

United States Patent [19]

Gallagher, Jr.

[11] Patent Number: 5,555,565

[45] Date of Patent: Sep. 17, 1996

[54] THICK PILE SOCK WITH HETEROGENEOUS BODY AND FOOT PORTIONS, AND SOCK SYSTEM THEREWITH

[75] Inventor: Joseph E. Gallagher, Jr., Mechanicsville, Pa.

[73] Assignee: Tanner Lynx Corporation, Flemington, N.J.

[21] Appl. No.: 493,909

[22] Filed: Jun. 23, 1995

[51] Int. Cl.[6] ..... A41B 11/00; A43B 17/00; D04B 9/46

[52] U.S. Cl. ..... 2/239; 66/185; 66/202

[58] Field of Search ..... 66/178 R, 171, 66/185, 186, 187, 188, 202, 194, 191; 2/239, 240, 241; 57/252, 256

[56] References Cited

U.S. PATENT DOCUMENTS

| | | | |
|---|---|---|---|
| 2,384,079 | 9/1945 | Davis | 2/241 X |
| 2,416,208 | 2/1947 | Oppenheim | 57/256 |
| 2,436,904 | 3/1948 | Shea | 66/92 X |
| 3,078,543 | 2/1963 | Bloch | 57/256 X |
| 3,251,097 | 5/1966 | Faw et al. | 57/256 X |
| 4,255,819 | 5/1981 | Klingspor | 66/185 X |
| 4,373,361 | 2/1983 | Thorneburg | 66/185 X |
| 5,155,989 | 10/1992 | Frey et al. | 57/256 X |

FOREIGN PATENT DOCUMENTS

| | | | |
|---|---|---|---|
| 159411 | 10/1985 | European Pat. Off. | 2/239 |
| 7907044 | 4/1980 | Netherlands | 2/241 |

*Primary Examiner*—John J. Calvert
*Attorney, Agent, or Firm*—Kenneth P. Glynn

[57] ABSTRACT

The present invention is directed to a thick pile sock which has heterogeneous body and foot portions. The foot portion has a heel, a toe and a base and is made out of a fiber which is an intimate blend of synthetic and natural fibers whereby the synthetic fibers enhance structure and wicking action and the natural fibers enhance absorption and resiliency. The body portion begins at least one and one-half inches above the heel of the foot portion and is made out of a fiber that is at least 60% of the intimate blend of synthetic and natural fibers of the foot portion with the balance being a heterogeneous elastic synthetic fiber. The thick pile sock can also be worn over an inner sock as part of a sock system.

17 Claims, 2 Drawing Sheets

THICK PILE SOCK WITH HETEROGENEOUS BODY AND FOOT PORTIONS, AND SOCK SYSTEM THEREWITH

BACKGROUND OF THE INVENTION

1. Field of the Invention

The present invention relates to socks for maintaining coolness in the summer, retaining heat in the winter and immunizing detrimental effects of perspiration. These socks help to prevent injury resulting from physical activity and, further, they have been developed to disperse pressure points over body bone prominences by decreasing pressure.

2. Information Disclosure Statement

In spite of increased commercialization and availability of specialty socks, cold weather socks, warm weather socks and athletic socks, existing socks and sock systems are not effective in functioning over broad temperature ranges, i.e. summer and winter conditions and are not necessarily effective in preventing injury. The present invention is highly effective in both warm and cold weather and aid in preventing injury, because its intimate blend of synthetic and natural fibers which, in its specific physical arrangement, creates wicking to help remove perspiration, to cool in the summer and hold heat in the winter and which disperses pressure over body bone prominences by decreasing pressure to reduce injury.

As commonly known in the art, there are socks made from wool. Wool socks provide absorption of moisture and resiliency. However, they lack a wicking action whereby heat and moisture are transported away from a sending surface, such as a foot.

Another common sock is a sock made from a polyester. Polyester socks provide a wicking action of transferring moisture and vapor, as well as provide strength. However, they lack absorption of moisture and resiliency capabilities.

Blends of natural and synthetic materials are known and have been created to benefit from properties of both materials. However, compromise between desired functions and structural integrity must be made or the socks will not form well to the foot or the ankle.

Notwithstanding the commonly known prior art, the present invention sock, having unique, heterogeneous body and foot portions, is neither taught nor rendered obvious thereby.

SUMMARY OF THE INVENTION

The present invention is directed to a thick pile sock which has heterogeneous body and foot portions. The foot portion has a heel, a toe and a base, and is made out of a fiber which disperses pressure points over body bone prominences by decreasing pressure and prevents separation of fibers under compression while retaining resiliency. The fiber is an intimate blend of synthetic and natural fibers whereby the synthetic fibers enhance structure and wicking action and the natural fibers enhance absorption and resiliency. The fiber is constructed as a reversed terry nap with the terry nap facing outwardly. Thus, a twist of fibers extends from the thick pile sock for "standing-off" a foot from a footwear.

The body portion begins at least one and one-half inches above the heel of the foot portion and extends upwardly therefrom. The body portion is made out of a fiber that is at least 60% of the intimate blend of synthetic and natural fibers of the foot portion with the balance being a heterogeneous elastic synthetic fiber.

The thick pile sock can used as part of a sock system in which the thick pile sock is worn over an inner sock.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention has an intimate combination of natural material, such as wool, and synthetic materials, such as polypropylene, and has separate, different (heterogeneous) body and foot portions, all of which make the sock absorbent, resilient and strong, as well as provide a wicking action. The foot portion has a heel, a toe and a base.

The fiber content of the foot portion dispenses pressure points over body bone prominences by decreasing pressure and prevents separation of fibers under compression while retaining resiliency. The synthetic fibers enhance structure and wicking action while the natural fibers enhance absorption and resiliency.

The foot portion may be made from a range of percentage combination of natural and synthetic fibers. The toe and the heel may be a different percentage combination of natural and synthetic fibers from the fiber percentages of the base and also may be different colors from the base.

The body portion begins at least one and one-half inches above the heel of the foot portion and extends upwardly from the heel. The body portion is made from a fiber which consists of at least 60% of the same fiber as that of the foot portion with the balance being a heterogeneous elastic synthetic fiber, such as multi-twisted nylon.

The body portion may be various lengths. Thus, the sock can be a knee sock, a crew sock, an athletic sock or the like.

There is an optional band attached to a top of the body portion. The band has an elastic fiber and provides for snug fitting of a top of the sock, thus aiding in preventing the sock from falling down.

The sock is effective in functioning over broad temperature ranges i.e. summer and winter conditions and is an aid in preventing injury. These advantages are due to it intimate blend of synthetic and natural fibers, which create wicking to help remove perspiration, to cool in the summer and to hold heat in the winter.

Figure 1:
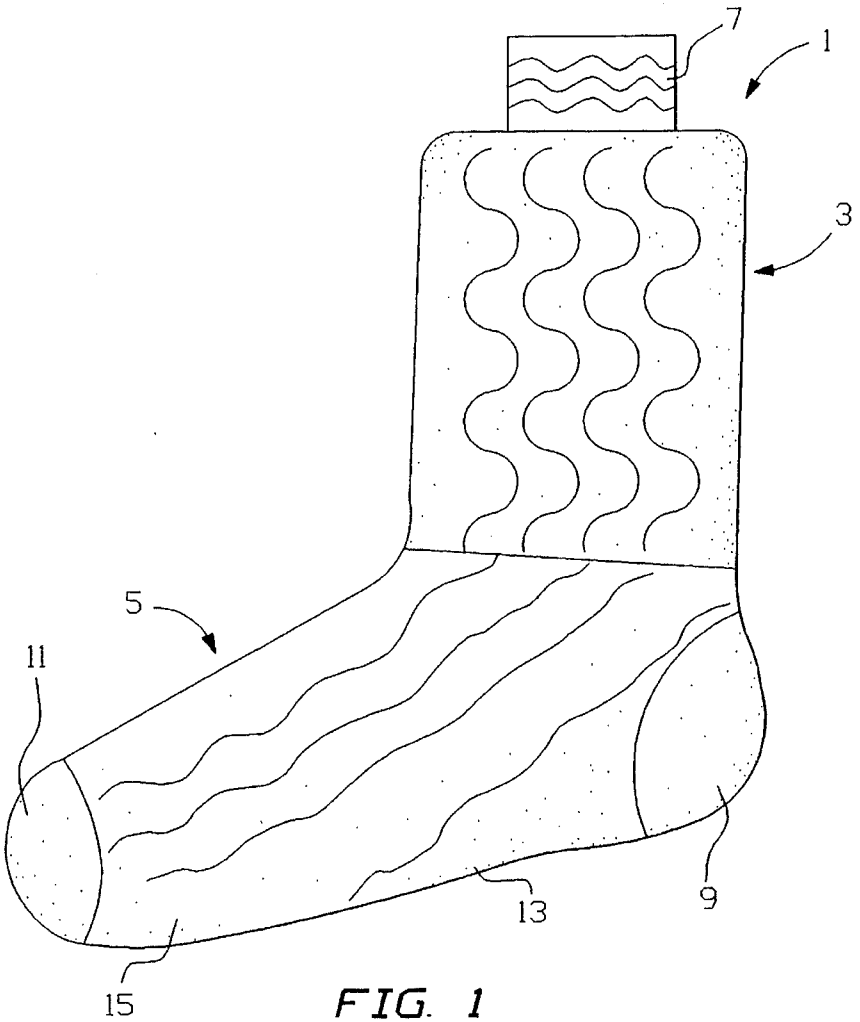
FIG. 1 is a schematic view of a thick pile sock in accordance with the present invention.

Referring now to FIG. 1, there is shown a schematic view of a thick pile sock 1. The thick pile sock 1 has heterogeneous body 3 and foot 5 portions and an optional band 7 attached to a top of the body portion 3.

The foot portion 5 has a heel 9, a toe 11 and a base 13, which are composed of a fiber consisting of an intimate blend of synthetic and natural fibers 15. The blend of fibers 15 disperses pressure points over body bone prominences by decreasing pressure and prevents separation of fibers 15 under compression while retaining resiliency. The synthetic fibers enhance structure and wicking action while the natural fibers enhance absorption and resiliency.

The outer limit of the percentage of natural fibers is approximately 40% to approximately 90% while the outer limit of the percentage of synthetic fibers is approximately 10% to approximately 60%. A preferable range is approximately 50% to approximately 90% natural fibers and approximately 10% to approximately 50% synthetic fibers while the most preferred percentage is 50% natural fibers and 50% synthetic fibers. The number of courses per inch vertical is in the range of 12 to 16 while 15 courses per inch is preferred. The composition and structure of the blend of fibers 15 is very tough and extremely durable. The blend of fibers 15 is knit on a 5.0 inch diameter head, single cylinder, 72 needle terry knitting machine.

The natural fibers may be wool, cotton, or wool/cotton blend. The synthetic fibers may be polypropylene, polyester or nylon. It should be understood that other synthetic fibers may be used, as long as they are capable of transferring moisture and provide a reasonable strong fiber blend 15 after being twisted with the natural fiber.

The blend of fibers 15 is constructed as a high density knit reversed terry nap 17 (see FIG. 2), which is designed to withstand maximum load conditions by having the terry nap 17 face a footwear. In addition, a twist of fibers 19 (see Fig.2) extending from the sock 1 provides maximum "stand-off" or friction reduction capability of a foot from the footwear. The high density knit reversed terry nap 17 also provides excellent insulation by trapping the ambient temperature of the outer footwear environment.

Because of the reversed terry nap construction, a surface opposite the terry nap 17 is smooth, thereby aiding in a transfer of heat and moisture to the blend of fibers 15 and insuring a smooth fit next to a skin. In addition, the smooth surface facilitates evaporation from the fibers.

The body portion 3 begins at least one and one-half inches above the heel 9 of the foot portion B and extends upwardly therefrom. The body portion 3 is made from at least 60% of the same intimate blend of synthetic and natural fibers 15 as the foot portion 5 with the balance being heterogeneous elastic fibers. The heterogeneous elastic fibers may be multi-twisted nylon or single count nylon.

The optional band 7 has an elastic fiber and provides for snug fitting at a top of the sock 1, thus aiding in preventing the sock 1 from falling down.

Figure 2:
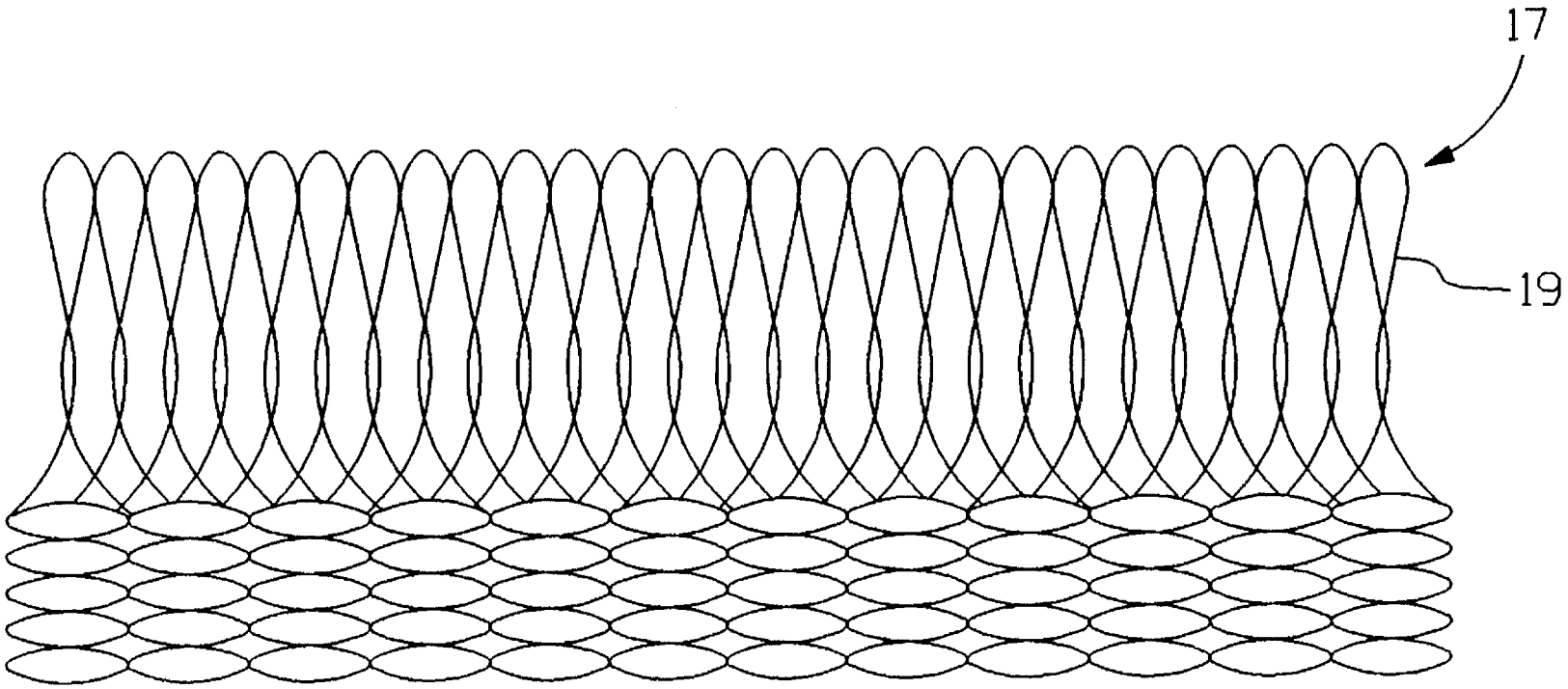
FIG. 2 is an enlarged view of a suitable terry nap knit for the thick pile sock shown in FIG. 1.

In FIG. 2, there is shown a high density terry nap 17 with a twist of fibers 19 extending from the sock 1. The high density terry nap 17 resists separation under high compression associated with bony prominences of the foot and insulates the foot from the footwear by yielding a shock absorbing surface. Thus, injury is prevented to a ball portion and a heel portion of the foot, as well as, injury in the from of toe irritation and Achilles tendon abrasions.

Figure 3:
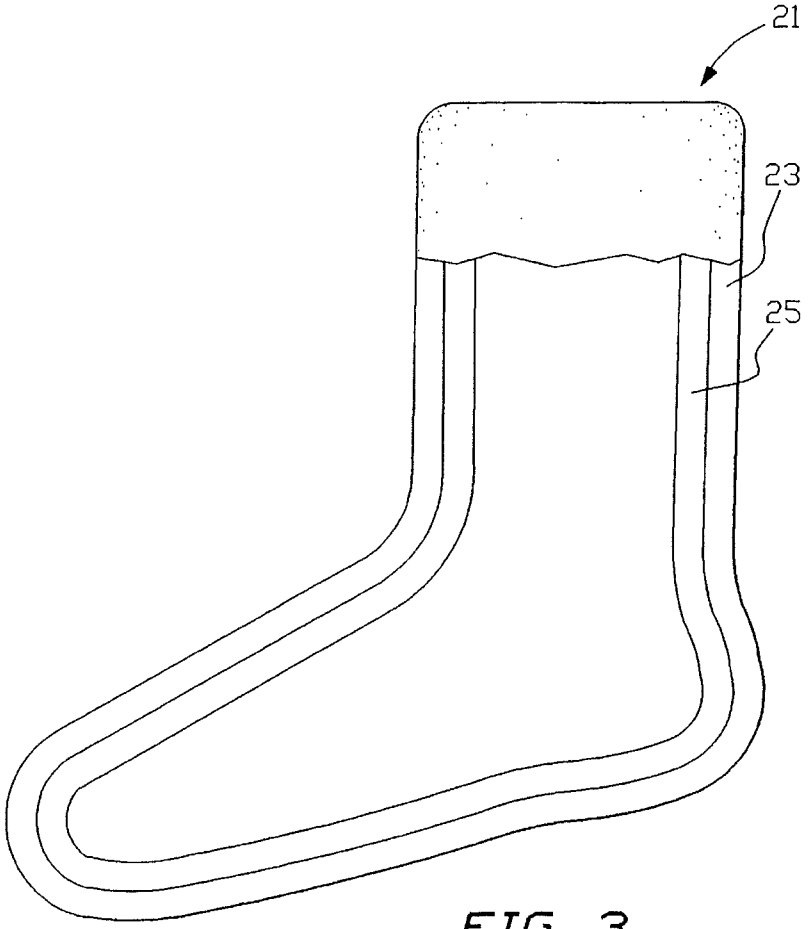
FIG. 3 is a schematic view of a sock system in accordance with the present invention.

Referring now to FIG. 3, there is shown a sock system 21 having a thick pile outer sock 23 worn over an inner liner sock 25. The outer sock 23 is the same as the thick pile sock 1 described in FIGS. 1 and 2. The inner sock 25 functions best when it is made out of a fiber that provides for a wicking action whereby heat and moisture are transported away from a surface next to a foot, through the inner sock 25 and to an outer surface of the inner sock 25. Because of the flat surface of the outer sock 23, the inner sock 25 will not become saturated. The following examples illustrate embodiments of the present invention:

Example 1—HEAVY WEIGHT ALL WEATHER SOCK

Description

The all weather sock is designed for use as a sock by itself, and, alternatively or in addition, may be used as the outer layer sock when worn in a system configuration with a separate, conventional inner sock. The sock is constructed of a high density reversed terry knit designed to withstand maximum load conditions and provide insulation. The high density knit construction and crimped fibers provide resiliency and loft. The nap is reversed and worn on the outside of the sock to provide maximum thermal properties.

Yarn

The yarn of the sock consists of 50% wool and 50% polypropylene. A 48's grade wool and 3 denier, 3 inch cut polypropylene are used. The yarn size is 70 grains for fifty yards, has seven turns per inch with a right twist per end, three ends used.

Knitting

The socks are knit on a 5.0" diameter head, single cylinder, 72 needle terry knitting machine. The knit is a high density reversed terry with 15 courses per inch vertical. Top is 1×1 rib by 3½ inches wide, 13 courses per inch.

Sewing

The toe seam arch form (fish mouth closure) is sewn using a Union Special 2/100's stretch nylon tow seam with 30 stitches per inch. The seam is laid side to side and finished on an Intek or comparable drying machine, and is dried vertically on the toe/heel form.

Sizes and Measurements

The all weather present invention sock may be provided in any size desired, e.g. in the following sizes: 3, 4, 5, 6, 7, 8, 9, 10, 11, 12, 13 and 14. The sizes may, for example, conform to the definitions of sizes given in Table 1 in the most current version of the National Association of Hosiery Manufacturers Sizing Standard for the Sizing of Men's, Women's and Children's Knee-High and Shorter Hosiery. The sock height shall be 12½" for sizes 3 through 6 and 14" on sizes 7 through 13/14.

Physical Requirements

The finished socks shall conform to the following requirements. The testing shall be as specified in FED-STD-191 unless otherwise specified.

| Characteristic | Requirement | Test Method |
|---|---|---|
| Material Stretch | No greater than 1¾ inches horizontally<br>No greater than 1½ inches vertically | 7540 |
| Cross Stretch | 8 inches at top of the sock | (A) |
| Weight per pair of socks | | |
| Sock Size | Ounces per pair | (C) |
| Size 4 | 4.66 | |
| Size 5 | 4.83 | |
| Size 6 | 4.91 | |
| Size 7 | 5.83 | |
| Size 8 | 6.16 | |
| Size 9 | 6.66 | |
| Size 10 | 7.00 | |
| Size 11 | 7.16 | |
| Size 12 | 7.66 | |
| Size 13 | 8.00 | |

-continued

| Characteristic | Requirement | Test Method |
|---|---|---|
| Size 14 | 8.16 | |
| Size 15 | 8.66 | |
| Size | | (D) |
| All sizes | Sock fits specified size | |
| Height | | (E) |
| Sizes 3–6 | 12½" | |
| Sizes 7–13/14 | 14" | |

(A) Cross stretch shall be 8 inches at the top of the sock from a five inch diameter head, single cylinder, 72 needle terry machine. Cross stretch shall be determined after the sock has been laundered at 140° F. for 20 minutes, dried and boarded.
(B) Variance of 5% by weight.
(C) Weight is determined by first conditioning the socks as directed in ASTM D1776. Socks are weighed to the nearest 0.1% of their weight.
(D) Sock size shall be determined in accordance with Appendix A of the most current version of the National Association of Hosiery Manufacturers Sizing Standard for the Sizing of Men's, Women's and Children's Knee-High and Shorter Hosiery.
(E) Sock height shall be measured from the bottom of the heel to the top of the sock.

EXAMPLE 2—SOCK SYSTEM: HEAVY WEIGHT ALL WEATHER SOCK WITH A HIGH WICKING, LINER SOCK

The sock described in Example 1 may be used as an outer sock in a system with the following inner sock:

Description

The single layer, wicking polyester inner (liner) sock is designed to be worn as part of the sock system. The liner sock promotes the natural cooling action of the body by wicking away moisture, keeping feet ultra-dry and comfortable while minimizing foot odor and bacteria build-up. The sock fibers transport heat and moisture away from the skin.

Yarn

The sock is knit from a polyester polymer base with a tetrachannel cross section (20/1 Coolmax fiber), 1.4 denier per filament 1½" staple length with 2 ends of 70's nylon. The percentages are 80% Coolmax and 20% nylon.

Knitting

The socks are knit on a 3¾ inch diameter, single cylinder, 132 needle knitting machine. Sewing The toe seam shall be a standard flat toe seam.

Sizes and Measurements

The liner sock shall be provided in the following sizes: 5–7, 7–9, 9–11, 11–13 and 13–16. The sizes shall conform to the definitions of sizes given in Table 1 in the most current version of the National Association of Hosiery Manufacturers Sizing Standard for the Sizing of Men's, Women's and Children's Knee-High and Shorter Hosiery. The sock height shall be 12" for sizes 5–7 and 7–9 and 14" for sizes 9–11, 10–13 and 13–16.

Physical Requirements

The finished socks shall conform to the following requirements. The testing shall be as specified in FED-STD-191 unless otherwise specified.

| Characteristic | Requirement | Test Method |
|---|---|---|
| Material Stretch | No greater than 1¾ inches horizontally<br>No greater than 1½ inches vertically | 7540 |

-continued

| Characteristic | Requirement | Test Method |
|---|---|---|
| Cross Stretch | 9¼"–9½" at top of the sock | (A) |
| Size | | (B) |
| All sizes | Sock fits specified size | |
| Weight per pair of socks | | (C) (D) |
| Sock Size | Ounces per pair (Grams per pair) | |
| 5–7 | 1.16 (32.49) | |
| 7–9 | 1.25 (35.01) | |
| 9–11 | 1.5 (42.01) | |
| 10–13 | 1.66 (46.68) | |
| 13–16 | 1.83 (51.35) | |
| Height | | (E) |
| Sizes 5–7, 7–9 | 12" | |
| Sizes 9–11, 10–13, 13–16 | 14" | |

(A) Cross stretch shall be 9¼"–9½" at the top of the sock from a five inch diameter head, single cylinder, 72 needle terry machine. Cross stretch shall be determined after the sock has been laundered, dried and boarded in accordance with the yarn manufacturers instructions.
(B) Sock size shall be determined in accordance with Appendix A of the most current version of the National Association of Hosiery Manufacturers Sizing Standard for the Sizing of Men's, Women's and Children's Knee-High and Shorter Hosiery.
(C) Variance of 5% by weight.
(D) Weight is determined by first conditioning the socks as directed in ASTM D1776. Socks are weighed to the nearest 0.1% of their weight.
(E) Sock height shall be measured from the bottom of the heel gore to the tip of the sock.

Obviously, numerous modifications and variations of the present invention are possible in light of the above teachings. For example, the synthetic fiber could be any fiber which enhances structure and wicking action while the natural fiber could be any fiber which enhances absorption and resiliency. It is therefore understood that within the scope of the appended claims, the invention may be practiced otherwise than as specifically described herein.

What is claimed is:

1. A thick pile sock, which comprises:

(a) a foot portion having a heel and toe and base, and having a fiber content for dispersion of pressure points over body bone prominences by decreasing pressure, and for prevention of separation of fibers under compression while retaining resiliency, which fiber content consists of an intimate blend of non-elastic synthetic and natural fibers, said non-elastic synthetic fibers being selected from the group consisting of polypropylene, polyester, nylon, polyacrylic materials, and mixtures of these, for enhancing structure and enhancing wicking action, and said natural fibers being selected from the group consisting of wool, cotton, and mixtures of these, for enhancing absorption and resiliency;

(b) a body portion beginning at least one and one-half inches above said heel of said foot portion, and extending upwardly therefrom, and having a fiber content which consists of at least 60% of said synthetic and natural fibers of said foot portion and the balance being heterogenous elastic synthetic fibers; and, (c) an elastic band located above said body portion and attached to an upper portion of said body portion.

2. The thick pile sock of claim 1 wherein said intimate blend of synthetic and natural fibers is a high density knit reversed terry nap.

3. The thick pile sock of claim 2 wherein said high density knit reversed terry nap faces outwardly.

4. The thick pile sock of claim 3 wherein said intimate blend of synthetic and natural fibers has a twist of fibers extending from said thick pile sock.

5. The thick pile sock of claim 1 wherein said intimate blend of synthetic and natural fibers is in the range of approximately 10% to approximately 60% synthetic fibers and approximately 40% to approximately 90% natural fibers.

6. The thick pile sock of claim 1 wherein said natural fiber is wool.

7. The thick pile sock of claim 1 wherein said synthetic fiber is polypropylene.

8. The thick pile sock of claim 1 wherein said heterogeneous elastic synthetic fiber is multi-twisted nylon.

9. The thick pile sock of claim 1 wherein said synthetic fiber is polyester and said natural fiber is wool.

10. A sock system, which comprises:

(a) a thick pile outer sock which comprises:

i). a foot portion having a heel and toe and base, and having a fiber content for dispersion of pressure points over body bone prominences by decreasing pressure, and for prevention of separation of fibers under compression while retaining resiliency, which fiber content consists of an intimate blend of non-elastic synthetic and natural fibers, said non-elastic synthetic fibers being selected from the group consisting of polypropylene, polyester, nylon, polyacrylic materials, and mixtures of these, for enhancing structure and enhancing wicking action, and said natural fibers being selected from the group consisting of wool, cotton, and mixtures of these, for enhancing absorption and resiliency;

ii). a body portion beginning at least one and one-half inches above said heel of said foot portion, and extending upwardly therefrom, and having a fiber content which consists of at least 60% of said synthetic and natural fibers of said foot portion and the balance being heterogenous elastic synthetic fibers; and, iii). an elastic band located above said body portion and attached to an upper portion of said body portion (b) a liner sock worn under said thick pile sock.

11. The sock system of claim 10 wherein, in said thick pile outer sock, said intimate blend of synthetic and natural fibers is a high density knit reversed terry nap.

12. The thick pile sock of claim 11 wherein said intimate blend of synthetic and natural fibers is in the range of approximately 10% to approximately 60% synthetic fibers and approximately 40% to approximately 90% natural fibers.

13. The thick pile sock of claim 10 wherein said natural fiber is wool.

14. The thick pile sock of claim 10 wherein said synthetic fiber is polypropylene.

15. The thick pile sock of claim 10 wherein said heterogeneous elastic synthetic fiber is multi-twisted nylon.

16. The sock system of claim 10 wherein said liner sock is a knitted sock containing a synthetic fiber and an elastic nylon, said synthetic fiber being selected from the group consisting of polypropylene, polyester, nylon, polyacrylic materials, and mixtures of these.

17. The sock system of claim 6 wherein said liner sock synthetic fiber is polyester.

* * * * *